US006412372B1

(12) United States Patent
Hsu

(10) Patent No.: US 6,412,372 B1
(45) Date of Patent: Jul. 2, 2002

(54) OPEN-END WRENCH WITH RESILIENT OPENING FUN EASY REPOSITIONING

(76) Inventor: Sheng-Ming Hsu, No. 448, Sec. 7 Chang-Lu Road, Fu-Hsing Hsiang, Chang-Hua Hsien (TW)

( * ) Notice: Subject to any disclaimer, the term of this patent is extended or adjusted under 35 U.S.C. 154(b) by 0 days.

(21) Appl. No.: 09/938,239

(22) Filed: Aug. 24, 2001

(51) Int. Cl.[7] ..... B25B 13/28
(52) U.S. Cl. ..... 81/111; 81/99
(58) Field of Search ..... 81/111, 92, 94, 81/97, 98, 99

(56) References Cited

U.S. PATENT DOCUMENTS 1,072,090 A * 9/1913 Cook ..... 81/99
3,901,106 A * 8/1975 Causey ..... 81/111
4,848,193 A * 7/1989 Wylie, III ..... 81/111
5,018,412 A * 5/1991 Wylie, III ..... 81/111
5,582,082 A * 12/1996 Gajo ..... 81/111
5,829,327 A * 11/1998 Stanton ..... 81/111
5,996,445 A * 12/1999 Wiens et al. ..... 81/111

* cited by examiner

*Primary Examiner*—Joseph J. Hail, III
*Assistant Examiner*—Joni B. Danganan
(74) *Attorney, Agent, or Firm*—Harrison & Egbert

(57) ABSTRACT

An open-end wrench includes a main body, a movable jaw plate, and a recovery element. The main body is provided at two longitudinal ends with a slot in which the movable jaw the plate is pivoted. The swiveling of the movable jaw plate is confined by a pin in conjunction with a position confining hole. The recovery element is located between a locating portion of the slot and a fastening portion of the movable jaw plate for providing the movable jaw plate with a recovery force.

2 Claims, 6 Drawing Sheets

OPEN-END WRENCH WITH RESILIENT OPENING FUN EASY REPOSITIONING

BACKGROUND OF THE INVENTION

1. Field of the Invention

The present invention relates generally to a wrench, and more particularly to an open-end wrench.

2. Description of Related Art

As shown in FIG. 1, an open-end wrench of the prior art has a handle 05, and two open ends 06 which are located at two longitudinal ends of the handle 05 for use in fastening or unfastening a hexagonal nut. This prior art open-end wrench is defective in design in that the open end 06 must be kept repositioning in the course of fastening or unfastening the nut. It is therefore readily apparent that the prior art open-end wrench is inefficient at best.

BRIEF SUMMARY OF THE INVENTION

The primary objective of the present invention is to provide an open-end wrench which is free of the drawback of the prior art open-end wrench described above.

In keeping with the principle of the present invention, the foregoing objective of the present invention is attained by an open-end wrench which has a handle, and two open ends located at two longitudinal ends of the handle. Each of the two open ends is formed with a fixed jaw and a movable jaw plate which is provided with a recovery element to furnish the movable jaw plate with a recovery force enabling the movable jaw plate to keep being fitted with a nut in the course of fastening or unfastening the nut.

The foregoing objective, features and functions of the present invention will be more readily understood upon a thoughtful deliberation of the following detailed description of a preferred embodiment of the present invention with reference to the accompanying drawings.

BRIEF DESCIPTION OF THE SEVERAL VIEWS OF THE DRAWINGS

DETAILED DESCRIPTION OF THE INVENTION

Figure 1:
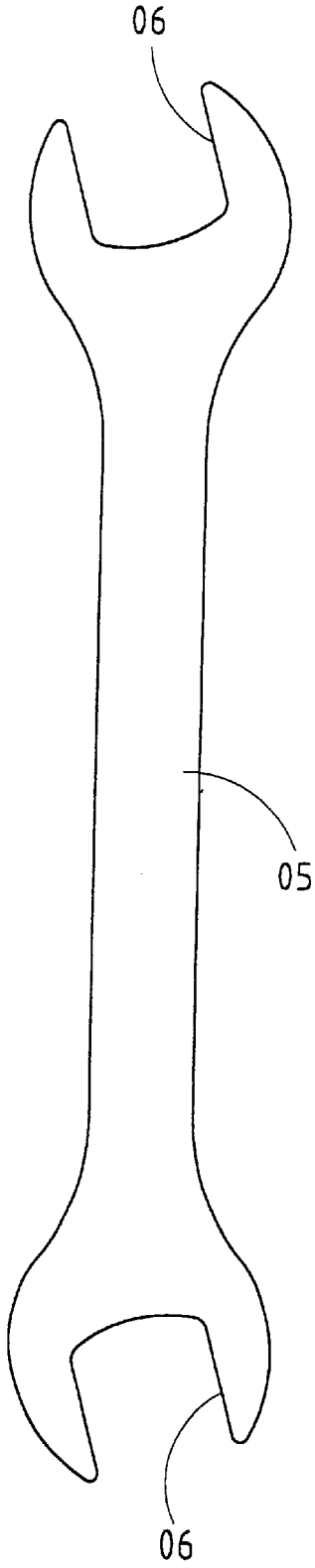
FIG.1 PRIOR ART
FIG. 1 shows a schematic plan view of an open-end wrench of the prior art.
Figure 2:
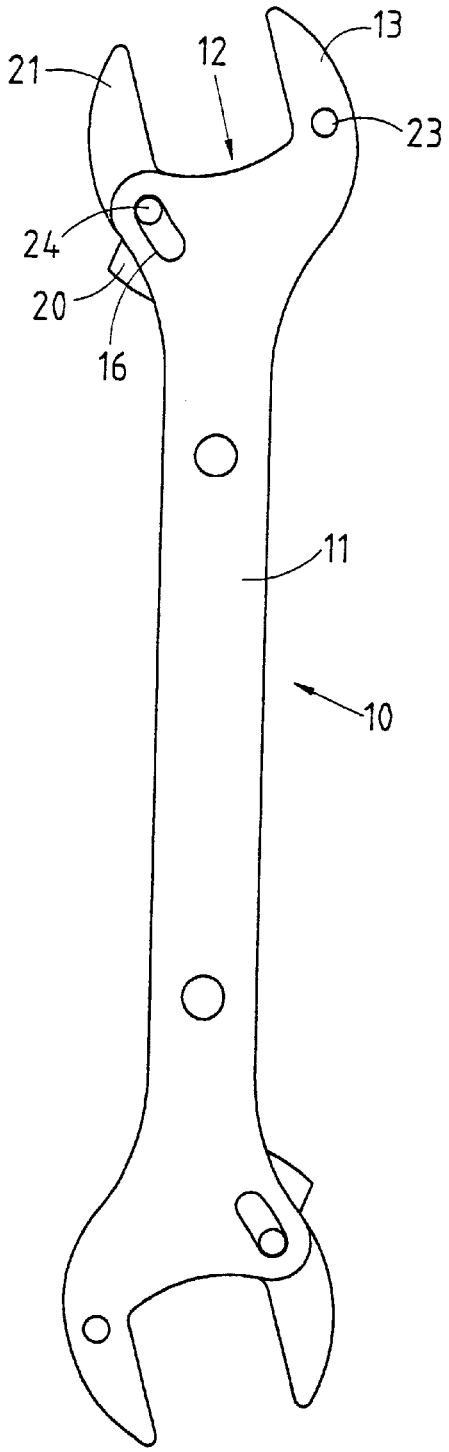
FIG. 2 shows a schematic plan view of an open-end wrench of the preferred embodiment of the present invention.
Figure 3:
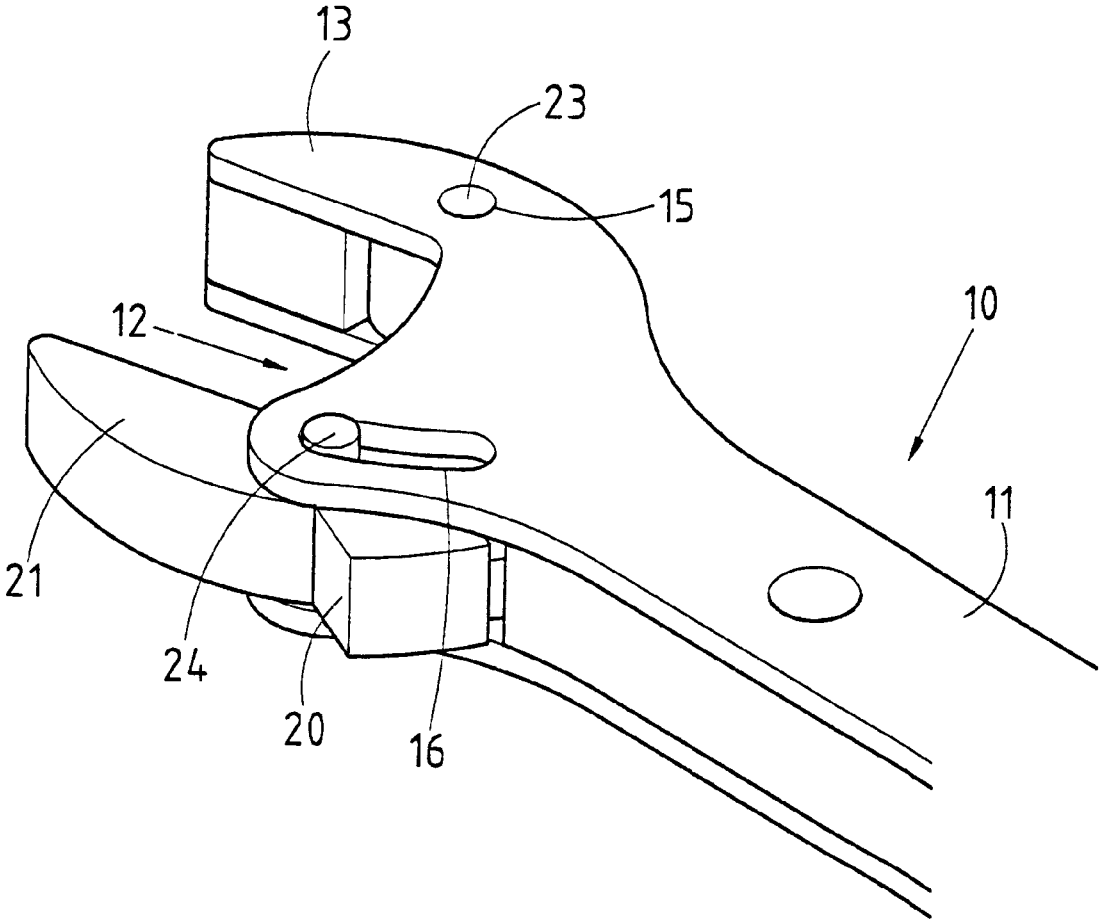
FIG. 3 shows a perspective view of the open end of the preferred embodiment of the present invention.
Figure 4:
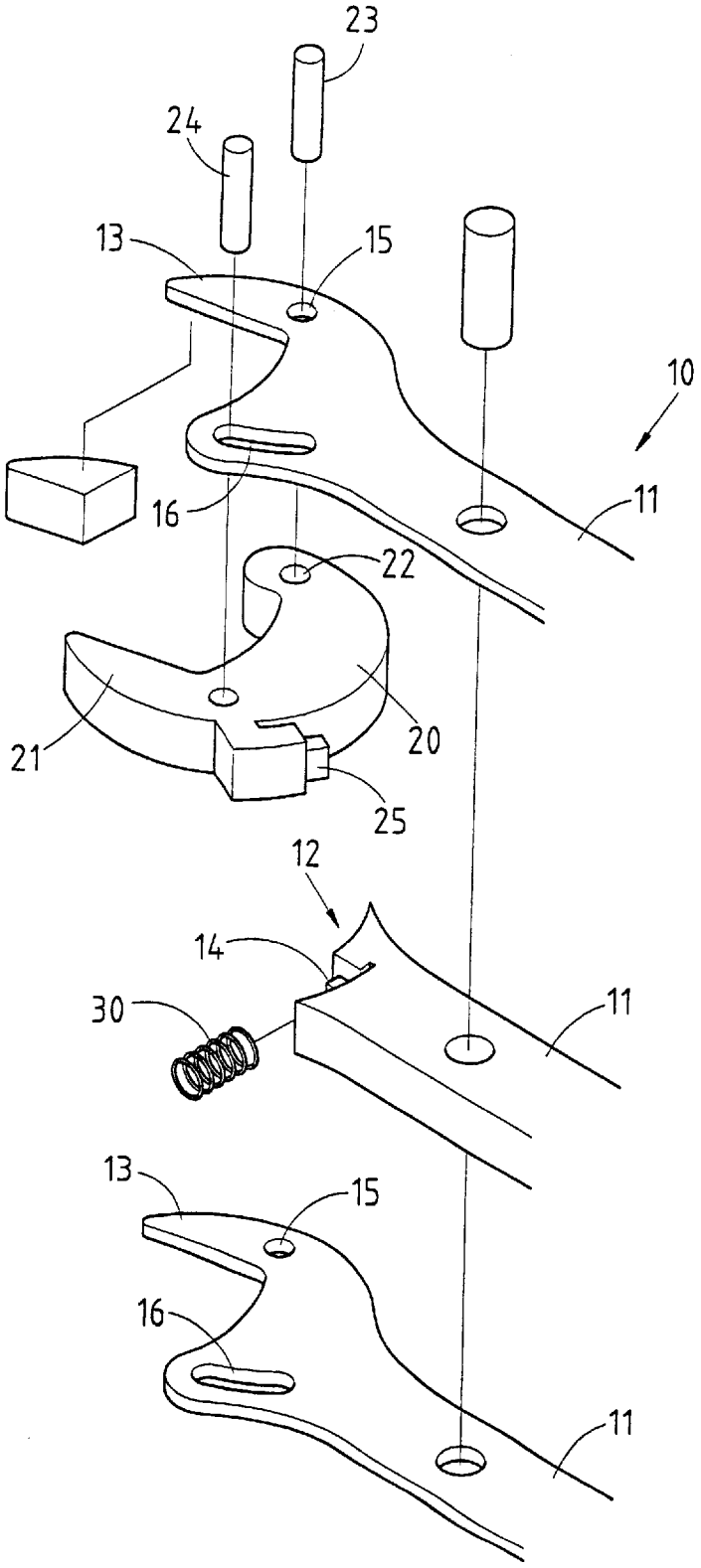
FIG. 4 shows an exploded view of the open end of the preferred embodiment of the present invention.

As shown in FIGS. 2–6, an open-end wrench of the preferred embodiment of the present invention comprises a main body 10, a movable jaw plate 20, and a recovery element 30.

The main body 10 has a handle portion 11 which is provided at two longitudinal ends with a U-shaped slot 12. The slot 12 is provided in one side with a fixed jaw 13, and in the inner side wall with a locating portion 14 for locating one end of the recovery element 30. The slot 12 is further provided in two side walls with a pivoting hole 15 and a position confining hole 16.

The movable jaw plate 20 is pivoted in the slot 12 such that a movable jaw portion 21 of the movable jaw plate 20 is opposite in location to the fixed jaw 13. The movable jaw plate 20 is provided with a through hole 22 corresponding in location to the pivoting hole 15 of the slot 12, and a bolt 23 which is put through the through hole 22 and the pivoting hole 15. The movable jaw plate 20 can be swiveled on the bolt 23. The movable jaw plate 20 is further provided with a pin 24 which is received in the position confining hole 16 for confining the displacement of the movable jaw plate 20. The movable jaw plate 20 is further provided with a fastening portion 25 for fastening other end of the recovery element 30.

The recovery element 30 is held securely between the locating portion 14 of the main body 10 and the fastening portion 25 of the movable jaw plate 20. The recovery element 30 may be a spiral spring.

Figure 5:
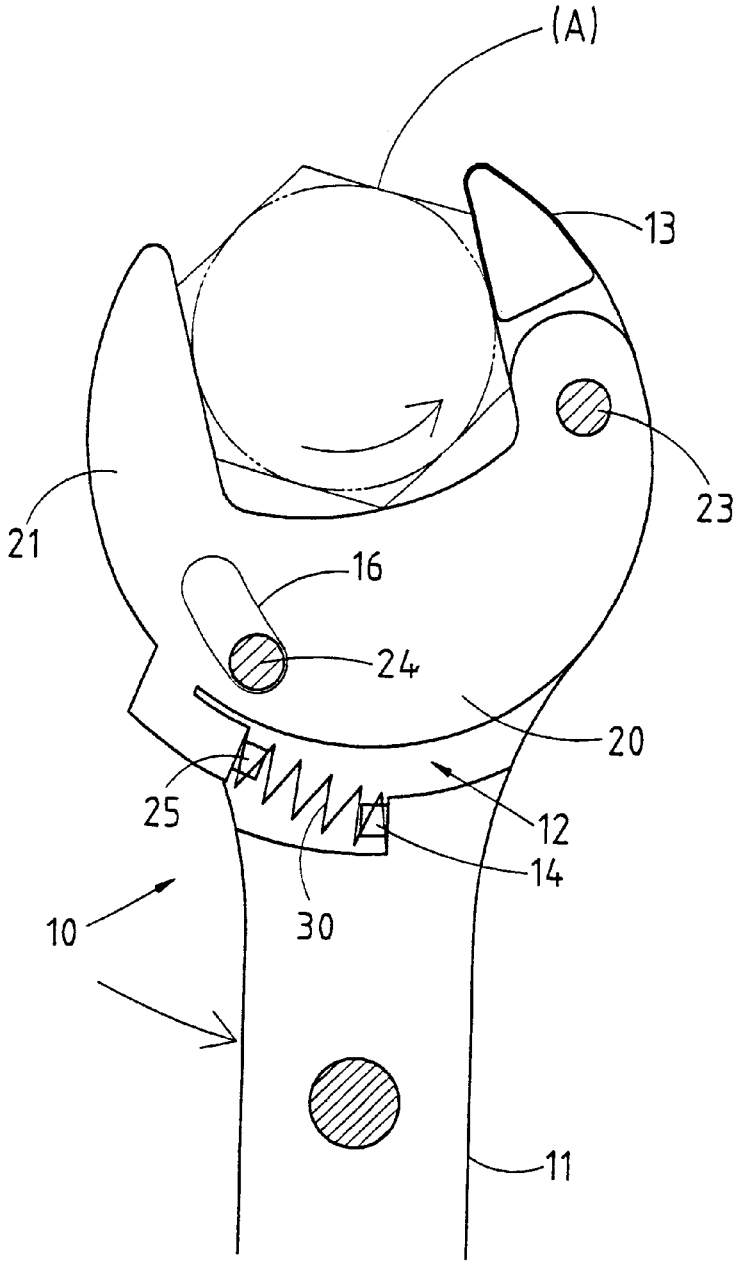
FIG. 5 shows a schematic view of the preferred embodiment of the present invention in action.

As illustrated in FIG. 5, when the handle portion 11 is turned in the direction toward the fixed jaw 13, the movable jaw plate 20 swivels on the bolt 23 such that the movable jaw portion 21 fastens a nut "A", thereby enabling the main body 10 to drive the nut "A" to turn.

Figure 6:
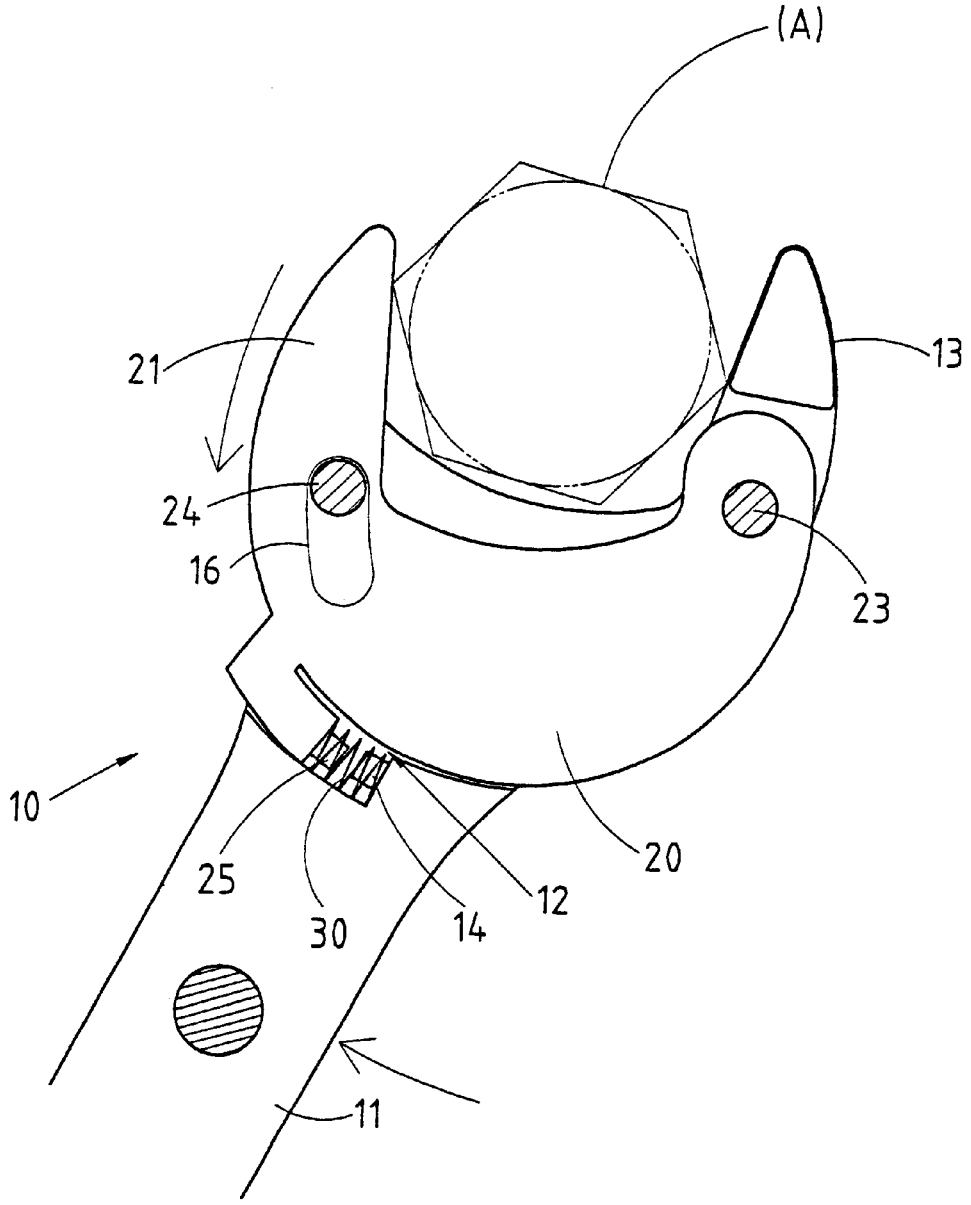
FIG. 6 shows another schematic view of the preferred embodiment of the present invention in action.

As shown in FIG. 6, when the handle portion 11 is turned in the direction toward the movable jaw portion 21 of the movable jaw plate 20, the movable jaw plate 20 is enabled by the recovery element 30 to swivel in that direction to open up the opening of the open end. As a result, the handle portion 11 can be turned back to its initial position without disengaging the nut "A". In light of the movable jaw plate 20 being urged by the recovery element 30, the movable jaw plate 20 is kept engaging the nut "A".

The preferred embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following claims.

I claim:

1. An open-end wrench comprising:

a main body having a handle portion having opposite longitudinal ends, each of said longitudinal ends having a jaw member defining a U-shaped slot therein, said jaw member having a fixed jaw portion on one side thereof, said jaw member having a locating portion on an interior wall thereof, said jaw member having a pair of side walls, each of said pair of side walls having a circular pivoting hole and an elongated position confining hole in spaced relation to said pivoting hole;

a movable jaw plate having a movable jaw portion, said movable jaw portion pivotally mounted between said pair of side walls of said jaw member, said movable jaw portion being opposite in location and generally facing said fixed jaw portion, said movable jaw plate having a circular through hole axially aligned with said pivoting hole of the side walls, said movable jaw plate having a fastening portion generally facing said locating portion of said jaw member, said movable jaw plate having another circular hole in spaced relation to said through hole;

a bolt received in said through hole of said movable jaw plate and in said pivoting hole of the side walls, said movable jaw plate being pivotable about said bolt;

a pin received in said position confining hole of the side walls and in said another circular hole of said movable jaw plate, said pin cooperative with said position confining hole so as to limit the pivoting of said movable jaw plate between said pair of side walls; and a single recovery element positioned between said handle portion and said movable jaw plate, one end of said recovery element received by said locating portion, an opposite end of said recovery element received by said fastening portion of said movable jaw plate.

2. The open-end wrench of claim 1, said recovery element being a spiral spring.

* * * * *